US005377749A

United States Patent [19]

Barbee

[11] Patent Number: 5,377,749

[45] Date of Patent: Jan. 3, 1995

[54] APPARATUS FOR SETTING HYDRAULIC PACKERS AND FOR PLACING A GRAVEL PACK IN A DOWNHOLE OIL AND GAS WELL

[76] Inventor: Phil Barbee, P.O. Box 2005, Gretna, La. 70054-2005

[21] Appl. No.: 106,348

[22] Filed: Aug. 12, 1993

[51] Int. Cl.[6] ..... E21B 33/128; E21B 43/04

[52] U.S. Cl. ..... 166/120; 166/51; 166/126

[58] Field of Search ..... 166/387, 120, 126, 77, 166/278, 51

[56] References Cited

U.S. PATENT DOCUMENTS

| | | | |
|---|---|---|---|
| 4,441,561 | 4/1984 | DEX | 166/77 X |
| 4,688,634 | 8/1987 | Lustig et al. | 166/120 |
| 4,823,882 | 4/1989 | Stokley et al. | 166/387 |
| 4,936,387 | 6/1990 | Rubbo | 166/387 |
| 5,069,280 | 12/1991 | McKee et al. | 166/278 |
| 5,291,947 | 3/1994 | Stracke | 277/34.6 X |
| 5,305,828 | 4/1994 | White et al. | 166/120 |

FOREIGN PATENT DOCUMENTS

| | | | |
|---|---|---|---|
| 691552 | 10/1979 | U.S.S.R. | 166/120 |

OTHER PUBLICATIONS

1993 World Oil's Coiled Tubing Handbook.

A publication entitled "Louisiana Oil Tools Inc., Model 12 Sand Control System".

*Primary Examiner*—Hoang C. Dang

*Attorney, Agent, or Firm*—Pravel, Hewitt, Kimball & Krieger

[57] ABSTRACT

A hydraulic oil and gas well downhole packer apparatus for use in a well casing below a wellhead and in combination with a coil tubing unit provides a tool body having a longitudinally extending tool bore and an upper end portion that connects to the lower free end of the coiled tubing unit during use. The tool body includes an inner elongated hollow mandrel with a hydraulic piston movable disposed upon the external surface of the mandrel. The piston is movable between an initial "running" position and a final "setting" position. An external sleeve is engaged by the piston when it moves between the running and setting positions, the external sleeve engaging slips that expand to anchor the tool body to the well casing. An annular packer member is expandable responsive to sliding movement of the external sleeve and is positioned below the slips for forming a seal between the tool body and the casing at a position near the lower end portion of the tool body.

16 Claims, 9 Drawing Sheets

10
29
30
37
32
64
63
80
61
15
58
60
77
59
56
22
55
54
52
51

10
29
30
38
39
37
42
80
32
64
63
61
58
60
77
59
56
22
50
15
52
51

10
29
30
34
31
33
38
35
37
39
36
85
84
32
62
63
61
58
60
77
59
56
53
55
50
54
52
51

10
29
38
37
39
85
84
32
62
63
64
63
61
58
60
57
77
59
56
22
53
55
50
51

APPARATUS FOR SETTING HYDRAULIC PACKERS AND FOR PLACING A GRAVEL PACK IN A DOWNHOLE OIL AND GAS WELL

BACKGROUND OF THE INVENTION

1. Field of the Invention

The present invention relates to downhole oil well tools, and more particularly relates to an improved method and apparatus for setting a gravel pack in a downhole oil and gas well environment.

2. General Background

There are a number of applications in the oil and gas well drilling industry where it is desirable to install a packer in an oil and gas well whose "annulus" or internal diameter is restricted by existing equipment. One downhole oil and gas well delivery system is known in the industry as a "coil tubing" unit. By using a coil tubing unit, it is possible to run a tool in a well that is very restricted in diameter because of existing equipment. However, there are many oil and gas well drilling operations that are not feasible heretofore with the small diameter coil tubing units.

SUMMARY OF THE INVENTION

The present invention provides an improved oil and gas well downhole packer apparatus for use in well casing below wellhead and in combination with a coil tubing unit having an elongated coil tubing portion, a reel portion for coiling the tubing thereupon, and a free end portion of the tubing that can be transmitted into the well casing below the wellhead area.

In the preferred embodiment, the apparatus includes a tool body having a central longitudinally extending hollow tool body bore, an upper end portion and a lower end portion. Threads at the top end portion of the tool body assembly are provided for forming a connection between the tool body assembly and the lowermost free end portion of the coil tubing. In this fashion, as coil tubing is unwound from the reel, the coil tubing pays out and the free end portion of the coil tubing lowers into the well with the tool body attached.

The coil tubing provides a bore that can be used to transmit pressurized fluid to the tool body during use. This is important because the hydraulic pressure transmitted to the tool body via the coil tubing unit is used to activate the tool body such as, for example, in setting of the packer. Further, the bore of the coil tubing unit is used to transmit coarse sand or gravel from the wellhead area to the tool body for use in gravel packing operation. The tool body includes an elongated tubular inner mandrel having a polished inner bore, a hydraulic piston that is movably disposed upon the mandrel between a first running position and a second setting position. An external sleeve portion of the tool body surrounds the mandrel and the piston and can be in several parts connected end to end. The external sleeve defines a sliding portion that connects for movement with the hydraulic piston when the hydraulic piston moves from the initial running position to the second setting position.

Slips on the lower end portion of the tool body are annularly spaced around the mandrel for engaging the well casing to anchor the tool body to the casing at a selected position. Means is provided for forming a connection between the piston and the slips for activating the slips to grip the well casing.

An expandable annular packer is provided for forming a seal with the well casing and between the well casing and the inner mandrel. The packer is expandable responsive to movement of a sliding portion of a tool so that the packer expands when the piston moves downwardly from the initial running position to the final setting position.

In the preferred embodiment, the packer is a resilient member such as, for example, a rubber or polymeric construction. In the preferred embodiment, the coil tubing and tool body are sized to enter a very restricted well bore such as, for example, an internal diameter of about two inches or less.

During use, the tool body assembly comprises in part an uppermost running tool portion that includes means for connecting the running tool portion to the coil tubing.

The method of the present invention provides a method for gravel packing in oil and gas well having a wellhead at the earth's surface and a well annulus defined by the well casing. The method includes the initial step of lowering a packer having a valving member into the well casing on the coil tubing string, and attached to the straight, free end portion of the coil tubing. The packer is placed in the well annulus and at a selected elevational position of the well casing to be packed with coarse sand or gravel.

The packer is activated to form an annular seal against the casing by elevating pressure in the coil tubing.

The valve is opened at a selected position below the seal element. After opening the valve, gravel or coarse sand as selected can be transmitted via the coil tubing unit bore and into the tool body bore with a carrying fluid. The coarse sand or gravel and carrying fluid enters the well annulus below the seal element.

In the method of the present invention, the valve member preferably includes a flapper type valve portion that opens responsive to an increase in pressure within the tool body bore.

In the preferred method, the tool body supports a screening member at the lower end portion of the tool body so that the carrying fluid that enters the well annulus can be returned to the surface via the screen and the bore of the tool body so that the screen prevents return flow of coarse sand and gravel that is used for the gravel pack.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

FIGS. 1–5 illustrate generally the preferred embodiment of the apparatus of the present invention designated generally by the numeral 10. Packer apparatus 10 is typically run on a coil tubing unit (see FIG. 1) 11 having a coiled portion 12 and an uncoiled portion 13.

Figure 1:
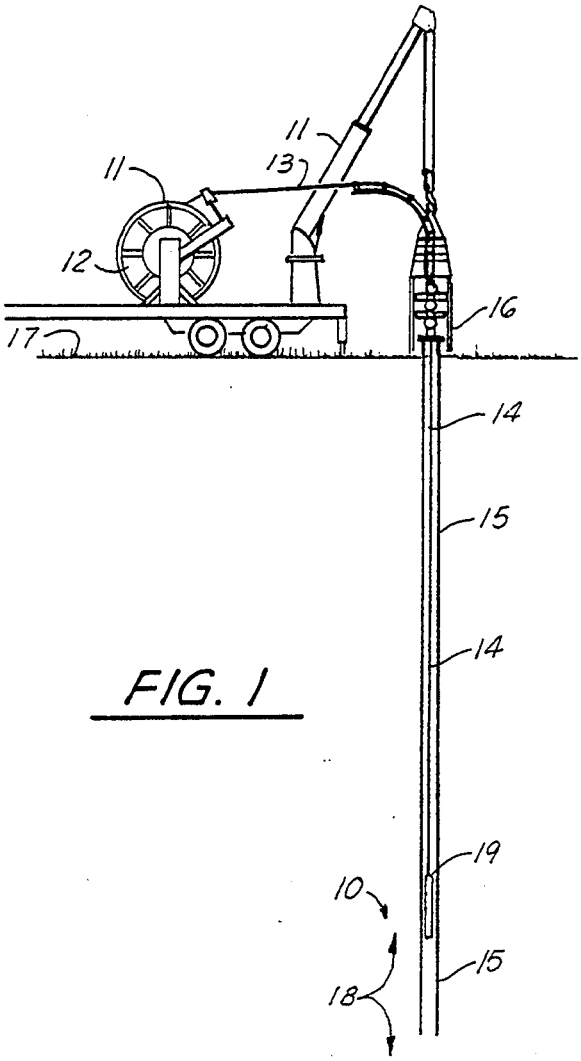
FIG. 1 is a schematic elevational view of the preferred embodiment of the apparatus of the present invention, and illustrating the method of the present invention.
Figure 8:
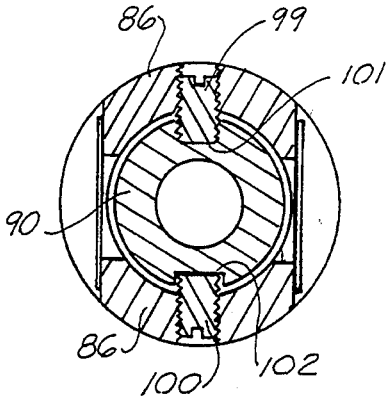
FIG. 8 is a sectional view of the embodiment of FIG. 6.
Figure 11:
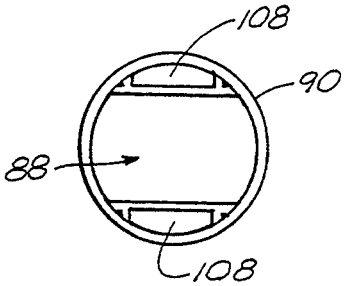
FIG. 11 is a sectional view taken along lines 11—11 of FIG. 9.

The coiled portion 12 is positioned at the earth's surface 17 and adjacent the wellhead 16 as shown in FIG. 1. An elongated downhole portion 14 of the coil tubing extends from the wellhead 16 and down into the well casing 15 until the lowermost end portion of the uncoil tubing 13 and its attached running tool 19 are placed adjacent formation 18 that defines a desired position for placement of the packer apparatus 10.

Figure 2:
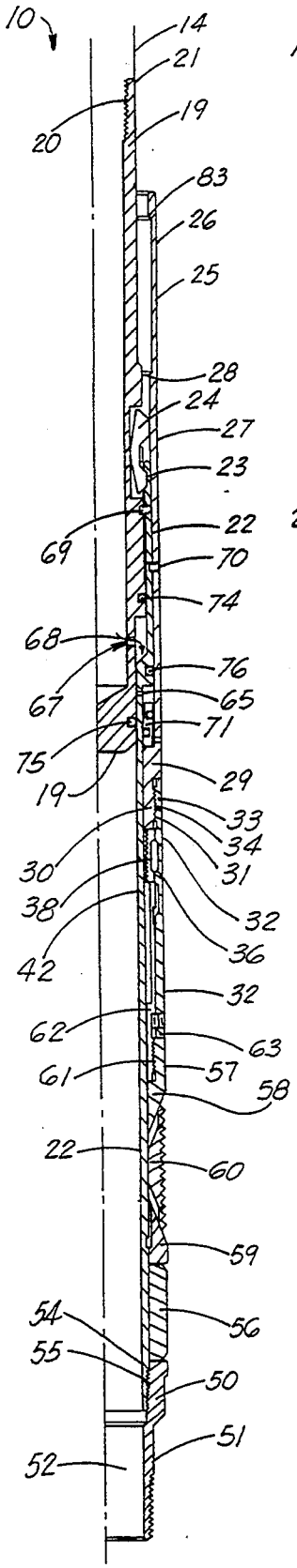
FIGS. 2, 2A, and 2B are sectional elevation views of the preferred embodiment of the apparatus of the present invention illustrating the running tool and packer prior to a setting of a packer.
Figure 2A:
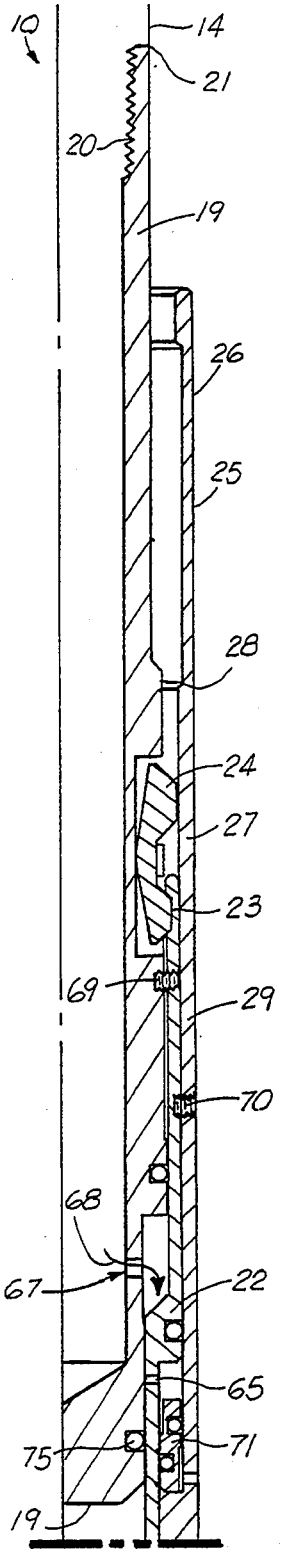

In FIGS. 2–2A, running tool 19 can be shown attached at internal threads 20 to the lower or free end of coil tubing downhole portion 14. A simple threaded connection can attach the coil tubing 14 to the running tool 19 at its upper end 21 portion. Running tool 19 attaches to mandrel 22 at an annular indentation 23. Rocker dog 24 engages the annular indentation 23 as shown in FIG. 2.

An annular elongated setting sleeve 25 is shown extending from a position below the upper end 21 of running tool 19 and downwardly. Setting sleeve 25 includes an upper portion 26, a medial portion 27, and a lower end portion 29. An annular shoulder 28 is positioned between upper end portion 26 and medial portion 27. A threaded section 30 of setting sleeve 25 at the lower end 29 portion thereof provides external threads 31 that engage threaded section 33 of sleeve 32. The external threads 31 engage threads 34 of threaded section 33 on sleeve 32.

Figure 7:
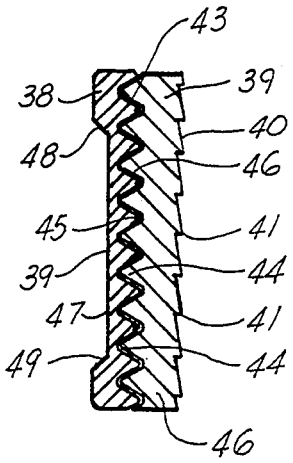
FIG. 7 is a fragmentary view of the preferred embodiment of the apparatus of the present invention illustrating the body lock ring portion thereof.

Below threaded section 33, sleeve 32 provides a pair of annular shoulders 35, 36 with an annular recess 37 therebetween. Recess 37 communicates with a plurality of curved lock ring sections 38, each of which threadably engages annular lock ring 39 as shown in FIG. 7. The annular lock ring 39 has an inner surface 40 with a plurality of annular ring-like serrations 41. Similar and corresponding annular serrations (not shown) are provided upon the outer surface of mandrel 42 but are inclined in an opposite direction from the serrations 41 on lock ring 39. Lock ring 39 has an outer surface 43 that provides a plurality of threads 44 that engage corresponding threads 45 on the rear surface 46 of each lock ring section 38. The front surface 47 of each lock ring surface 38 provides a pair of annular shoulders 48, 49 that align with the annular shoulders 35, 36 to define the annular recess 37 (see FIG. 2B). Serrations 41 and similar serrations on mandrel 42 ensure that lock ring 37 can only move in a downward direction relative to mandrel 42. The lock-ring 39 and annular segment 38 construction of FIGS. 2–5, 2A–5A, 2B–5B and 7 can also be used in the embodiment of FIGS. 6, 9–10, 9A–10A and 9B–10B, wherein only the recess 37 is sometime designated in the drawings for simplicity.

A check valve body 50 is disposed at the lower end portion of the mandrel 22, forming a threaded connection therewith as shown in FIGS. 2–5 and 2B–3B. Check valve body 50 provides an external threaded section 51 for the optional attachment of a commercially available check valve thereto. Check valve body 50 has an internal bore 52 and an internal threaded section 53 that attaches to the lower end 54 of mandrel 22 at external threads 55 of the mandrel 22.

Figure 4:
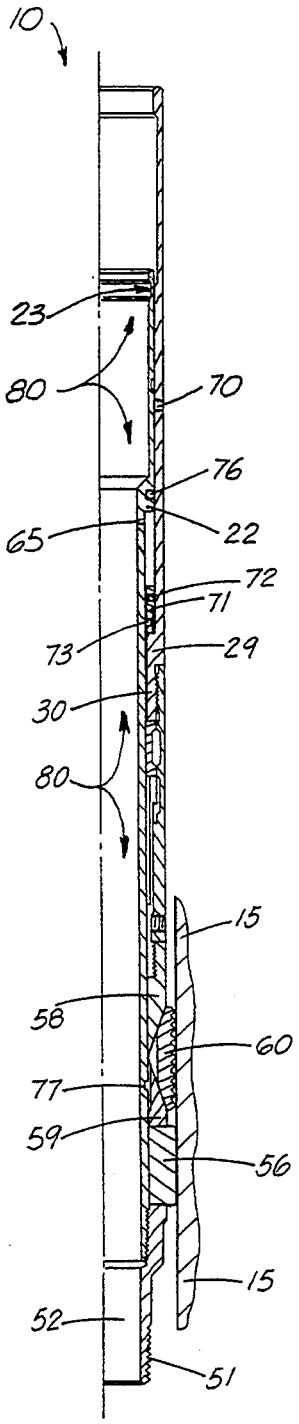
FIGS. 4, 4A, and 4B are sectional elevational views of the preferred embodiment of the apparatus of the present invention illustrating the packer in a set position and after removal of the running tool.
Figure 3:
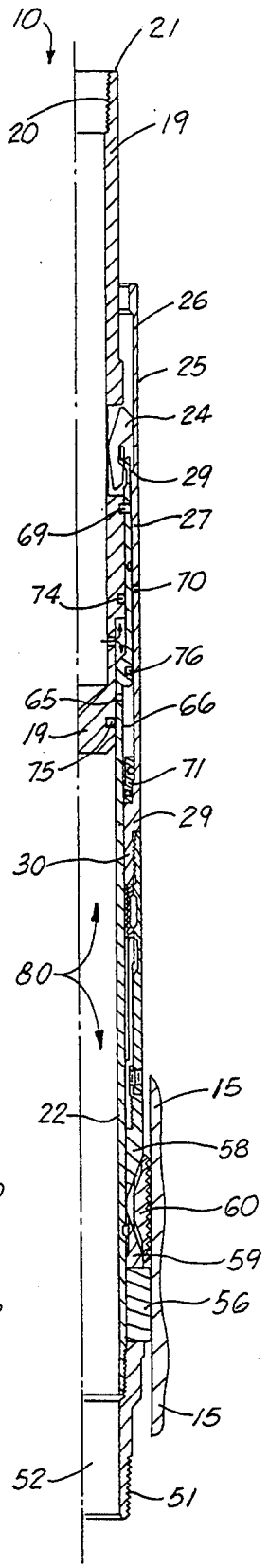
FIGS. 3, 3A, and 3B are sectional elevational views of the preferred embodiment of the apparatus of the present invention showing the packer in a setting position.

An annular packer element 56 is provided at the lower end 54 portion of mandrel 22. Annular packer element 56 can be of rubber for example. The annular packing element 56 is initially of a smaller thickness as shown in FIG. 2 and later expands to engage the casing 15, as shown in FIGS. 3 and 4. Cone assembly 57 comprises a pair of annular wedge elements 58, 59 that can expand slip 60 to the position shown in FIGS. 3B and 4B. The lower wedge element 59 and check valve body 50 compress annular packer element 56 therebetween as wedge element moves toward valve body 50.

Figure 4A:
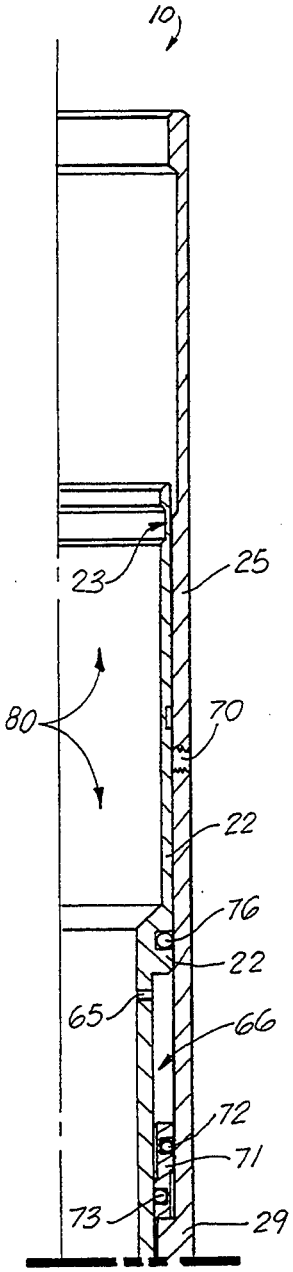
Figure 3A:
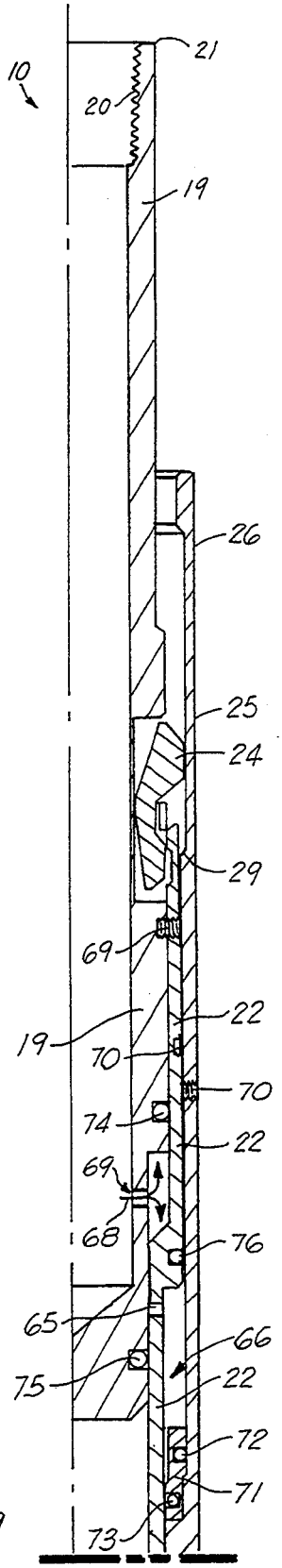
Figures 2B, 3B, 4B, 5B:
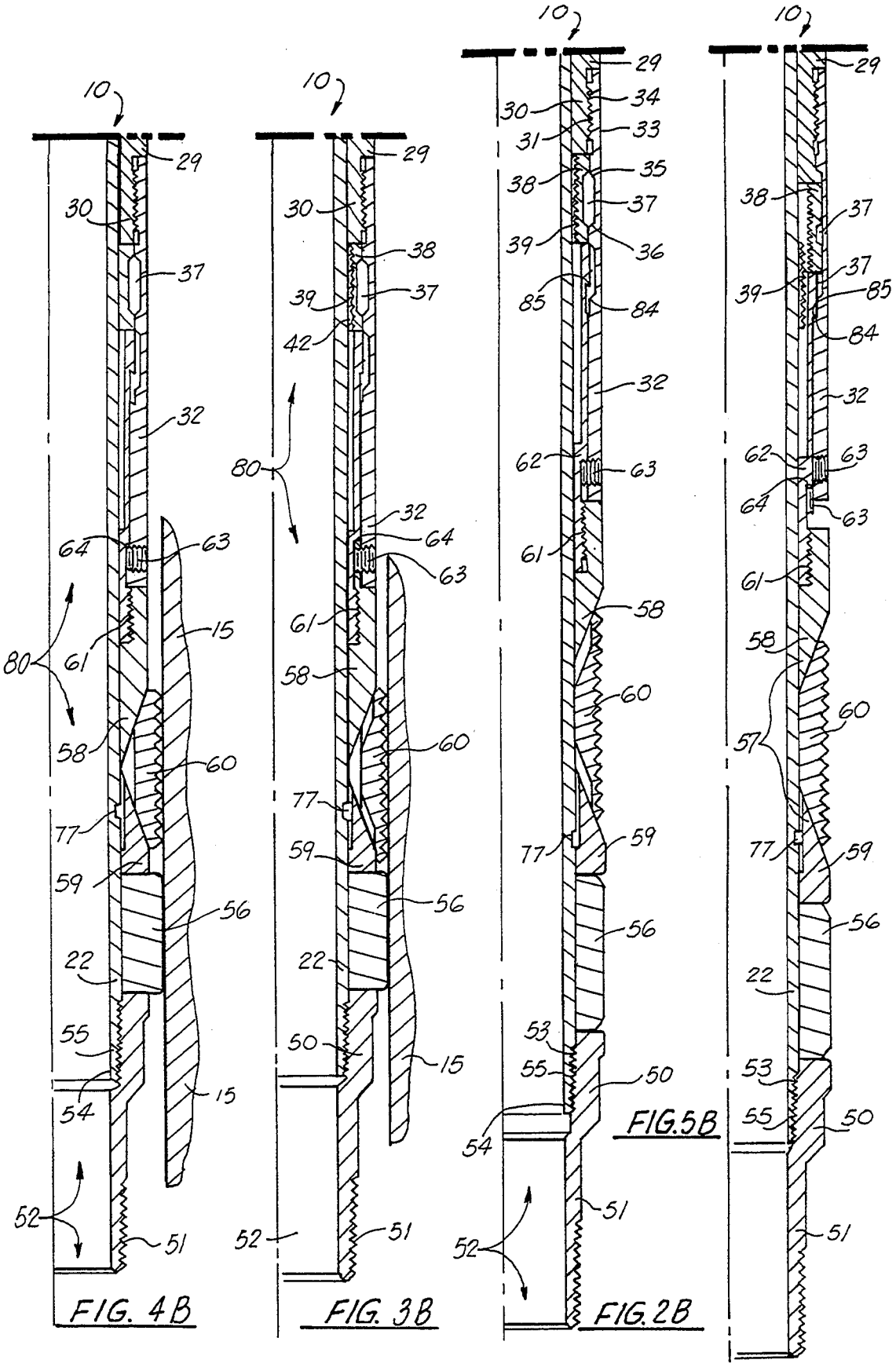

As the annular wedge elements 58, 59 are forced down, they approach each other and move slips 60 laterally away from mandrel 22 so that the slips engage casing 15 as shown in FIGS. 3 and 4. The retracted position of slips 60 is seen in FIGS. 2, 2A and 2B. A threaded connection 61 attaches upper annular wedge element 58 to sleeve 32 as shown in FIGS. 2–5. Annular sleeve 62 thus connects to cone assembly 57 at threaded connection 61. The annular sleeve 62 moves downwardly with sleeve 32 during use, urged downwardly by hydraulic piston 71.

Figure 5:
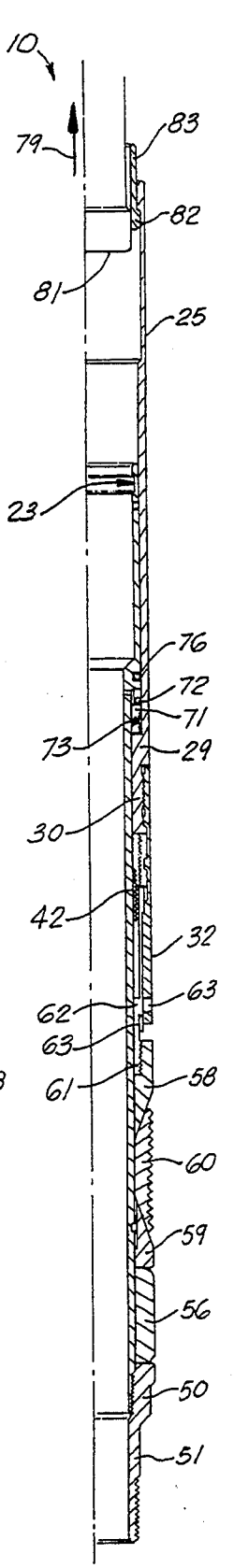
FIGS. 5, 5A, and 5B are sectional elevational views of the preferred embodiment of the apparatus of the present invention shown in a retrieving position with a retrieving tool engaging the packer.
Figure 5A:
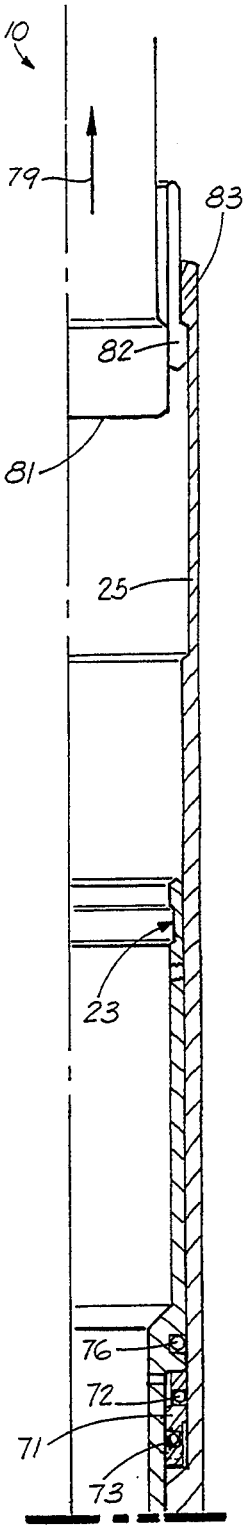

Set screw 63 forms a connection between sleeve 32 and annular sleeve 62 as shown in FIGS. 2–5 and 2A–5A, 2B–5B. Annular shoulder 64 of annular sleeve 62 rests upon the top of set screw 63. In FIGS. 5, 5A, and 5B, the set screw 63 as shown in a sheared condition. The set screw 63 shears when a retrieving tool 81 is used to remove the apparatus 10 from the well bore and casing 15.

In order to set the slips 60 and expand annular packer element 56, a hydraulically operated piston 71 is provided. The piston 71 (FIGS. 2A–5A) is sealed against mandrel 22 with O-ring 73. The piston 71 is sealed against setting sleeve 25 with O-ring 72. Port 65 allows fluid to travel from the tool internal bore 80 and into annular hydraulic chamber 66 for moving the piston 71 downwardly. The hydraulic chamber 66 communicates with port 67 via port 65, as shown by the arrows 68 in FIGS. 2–3.

In FIGS. 2 and D, 2A–2B, and 3A–3B, releasing screw 69 is shown forming a connection between running tool 19 and mandrel 22. Running screw 70 is shown in FIGS. 2–3, and 2A–2B, and 3A–3B, forming a connection between setting sleeve 25 and mandrel 22. The running screw 70 is sheared when piston 71 is activated and moved downwardly to expand packer 56 as shown in FIG. 3. The releasing screw 69 is sheared when the running tool is removed as shown in FIGS. 4, 4A–4B.

O-ring 74 forms a seal between running tool 19 and mandrel 22. O-ring 75 forms a seal between the lower end of running tool 19 and mandrel 22. The O-ring 76 forms a seal between mandrel 22 and setting sleeve 25.

Split ring 77 can be provided to form a stop for annular wedge element 59 in the preliminary position when packer element 56 is relaxed (see FIGS. 2 and 2B).

A retrieving tool 81 is shown in FIGS. 5 and 5A can be used for removing the apparatus 10 from the well casing 15. During removal, the retrieving tool 81 is pulled upwardly using the coil tubing unit 11 and pulling in the direction of arrow 79 (see FIGS. 5 and 5A). A lower annular lip 82 of retrieving tool 81 communicates with a similar annular lip 83 on the upper end of setting sleeve 25 as shown in FIG. 5. The application of upward pressure by retrieving tool 81 bears lip 82 against lip 83 and shears the set screw 63 as shown in FIG. 5 and 5B. Sleeve 32 then travels upwardly and the annular shoulder 84 of sleeve 32 engages a cooperating angular shoulder 85 at the top portion of sleeve 62. This upward movement of sleeve 62 raises wedge element 58 to the position shown in FIGS. 5 and 5B, relaxing pressure on slip 60 so that the slips 60 no longer grip casing 15. Upward movement of wedge element 58 also relieves pressure on wedge element 59 and seal 56 so that the packer 10 can be removed.

Figure 6:
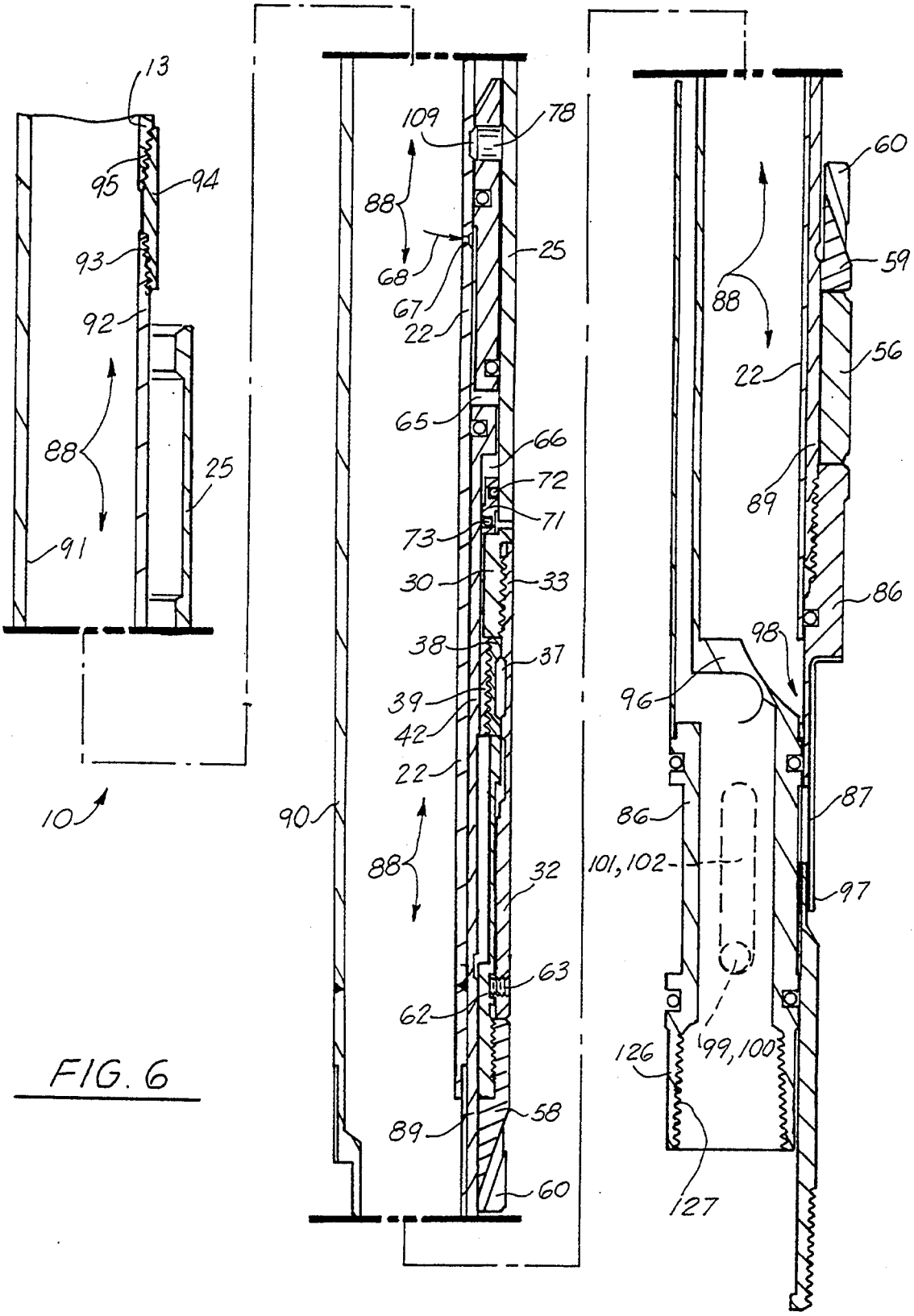
FIG. 6 is a sectional elevation view of the preferred embodiment of the apparatus of the present invention including a packer and cross over/running tool assembly placed for the installation of a through tubing gravel pack.
Figure 9:
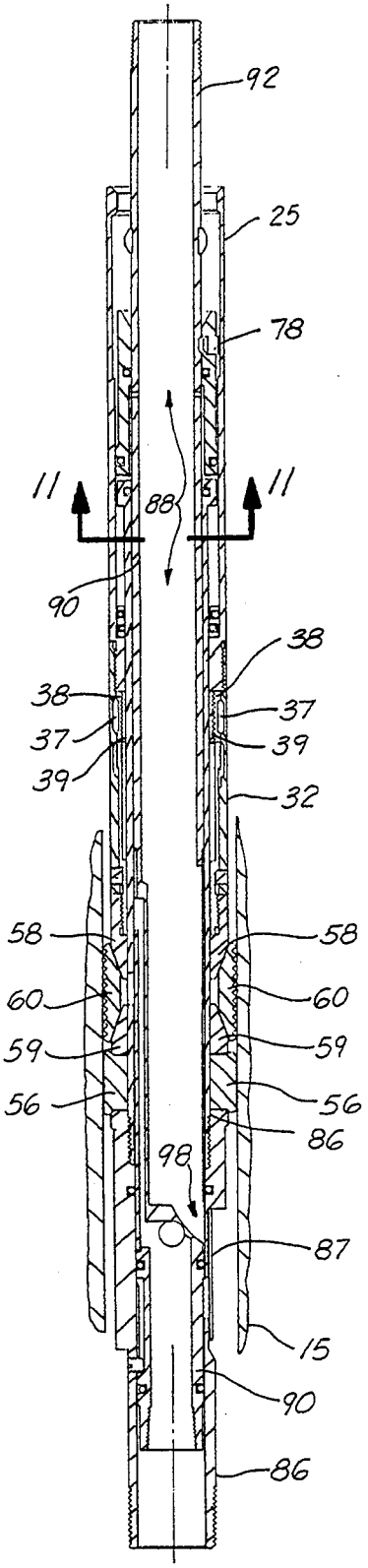
FIGS. 9, 9A and 9B are sectional elevational views of an alternate embodiment of the apparatus of the present invention useful in gravel packing operations.
Figure 9A:
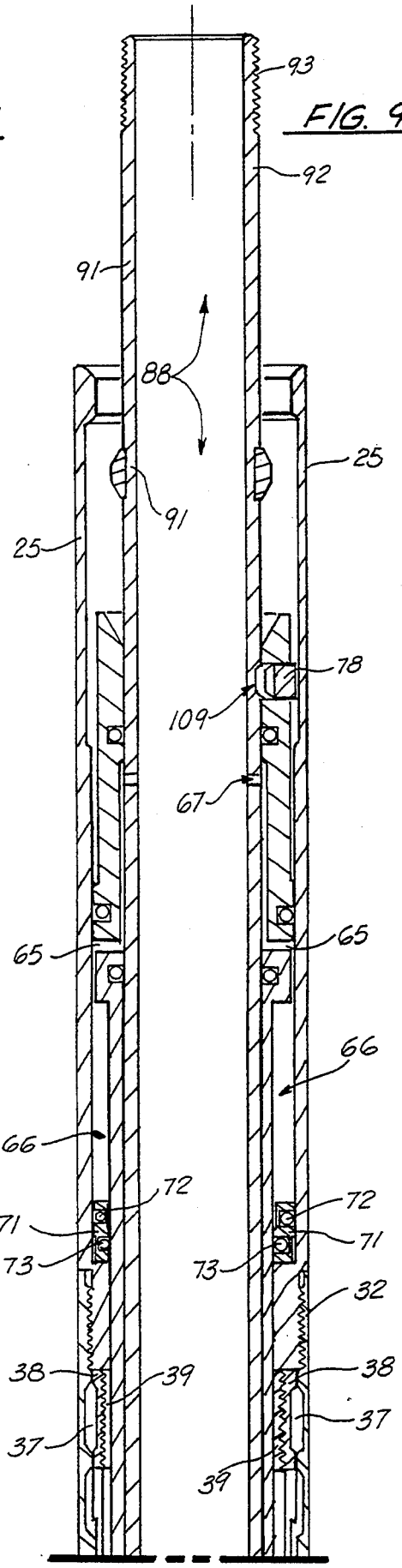

In FIG. 6, the apparatus 10 of the present invention is shown in use with a cross over running tool 90. The running tool 90 has an elongated cylindrically-shaped wall 91 with an upper end portion 92 that is threaded at 93 for connection to collar 94. The collar 94 has internal threads that connect with the threads 93 and with similar threads 95 at the bottom of coil tubing uncoiled portion 13. Such a collar 94 can also be used for connecting uncoiled portion 13 to running tool 19 in the embodiment of FIG 2. Lower end portion 126 of cross over tool 90 provides an internally threaded portion 127 for connecting wash pipe 106 thereto. In this configuration, running pins 78 register in annular recess 107 of in wall 91.

Running tool 25 communicates with piston 71 which is hydraulically activated as in the case of the embodiment of FIGS. 2–5. Thus, the piston 71 receives fluid pressure via hydraulic chamber 66. Fluid pressure enters port 67 and travels downwardly as shown by arrow 68 to port 65 and then between mandrel 22 and setting sleeve 25 to chamber 66.

Setting sleeve 25 forms a threaded connection with sleeve 32. The embodiment of FIG. 6 similarly provides the same slip ring arrangement of FIGS. 2–5 and 7. Further, the configuration of the cone assembly 57 and annular wedge element 59 is that shown in FIGS. 2–5 and 2A–5A, and 2B–5B. After slip 60 and packer 56 are set (FIGS. 9A–9B) piston 71 moves away from port 65. Running pins 78 have now move above annular shoulder 111 and release pressure applied to annular recess 109. The cross-over running tool 90 is now free to move up and down relative to the set packer element 56 and mandrel 89.

For movement of the cross over running tool 90, a pair of pins 99, 100 travel in slots 101, 102 respectively of cross over running tool 90. The pins 99, 100 threadably engage annular sleeve 86 which is threadably attached to elongated mandrel 89. Annular sleeve 66 carries a flapper valve member 87 that opens and closes when the cross over running tool 90 moves to a lower position. The movement of cross over running tool 90 between open and closed positions is defined by the elongated slots 101, 102, and the pair of pins 99, 100. The user lifts up on or lowers the coil tubing end 13 to move the tool 90.

In FIG. 6, the tool is in a closed flow position as valving member 87 is misaligned with port 98 of cross-over running tool 90. In this position, the pins 99, 100 are at the bottom of slots 101, 102. The slots 101, 102 can be shifted using coil tubing 13 to move tool 90 relative to pins 99, 100. The pins 99, 100 are affixed to annular sleeve 86. When the pins are moved to the top of the slots 101, 102, this shift in position aligns port 98 with valving member 87. The valving member 87 provides a valve flapper which is now free to open under the pressure of fluidized gravel which can be transmitted via coil tubing unit 11 to flow into bore 80, the path of flow defined by arrows 103.

Figure 10:
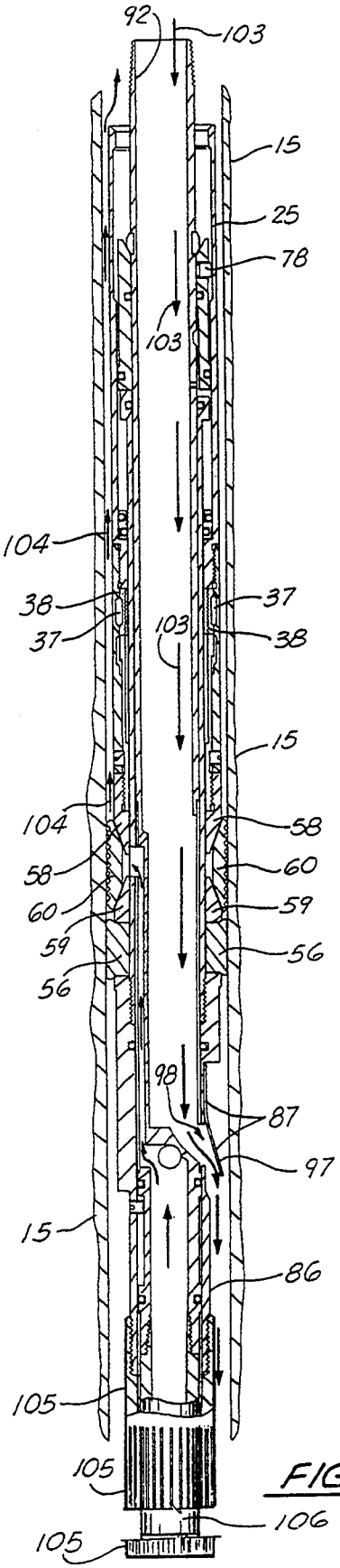
FIGS. 10, 10A and 10B are sectional elevational views of an alternate embodiment of the apparatus of the present invention useful in gravel packing operations and showing the retaining valve portion in open flow position during the transmission of gravel to the well annulus.
Figure 10A:
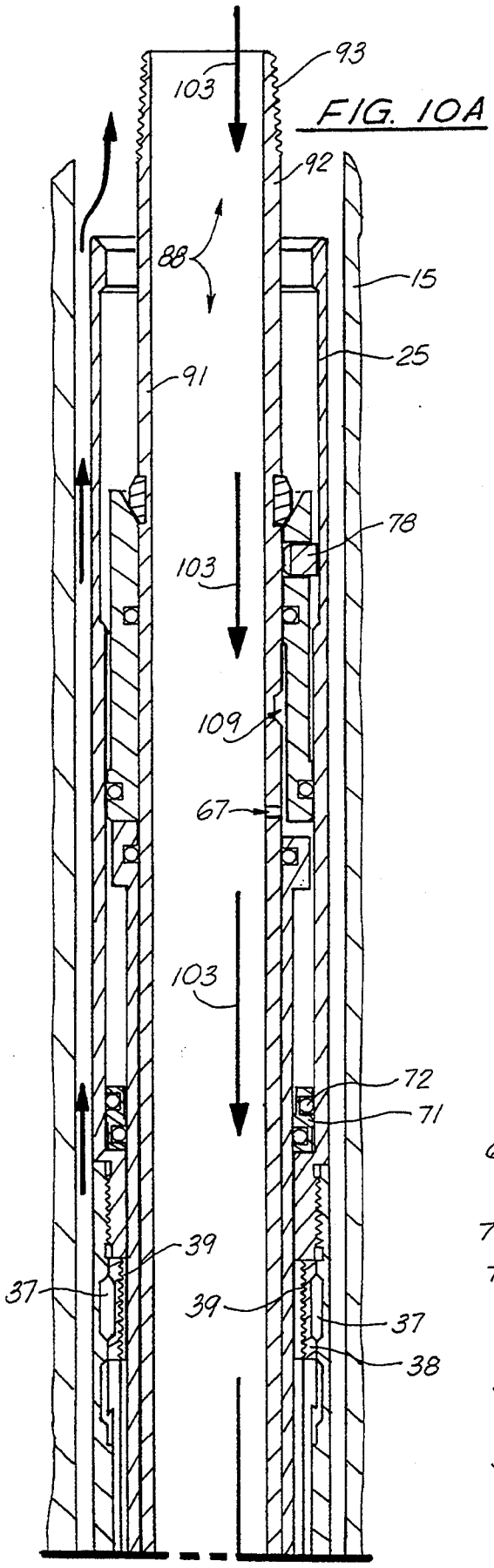
Figure 10B:
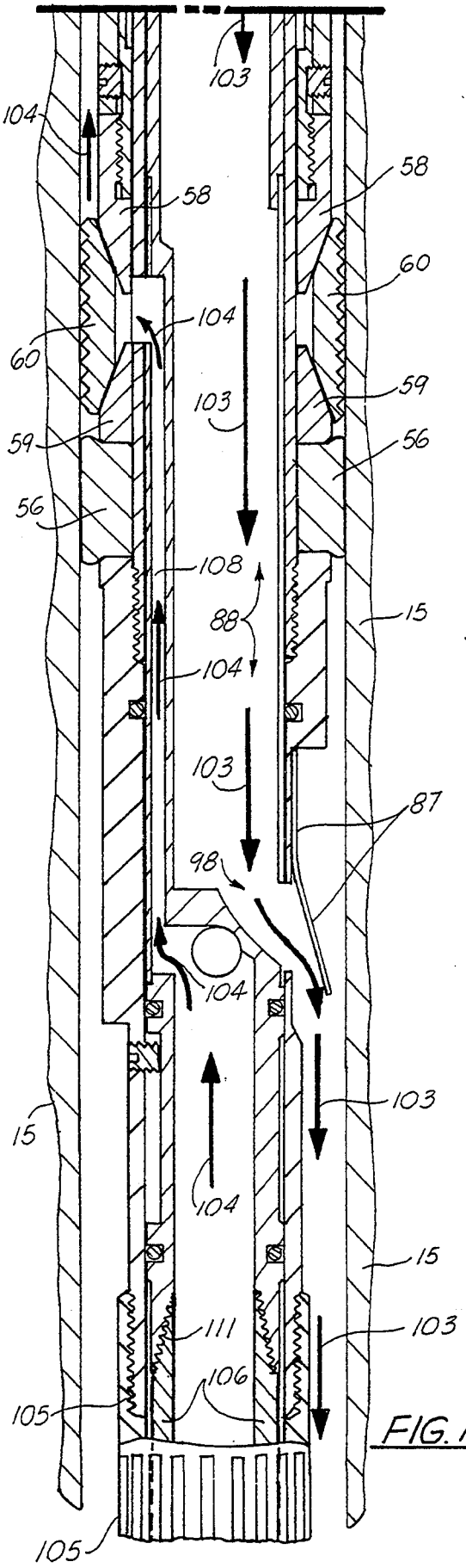
Figure 9B:
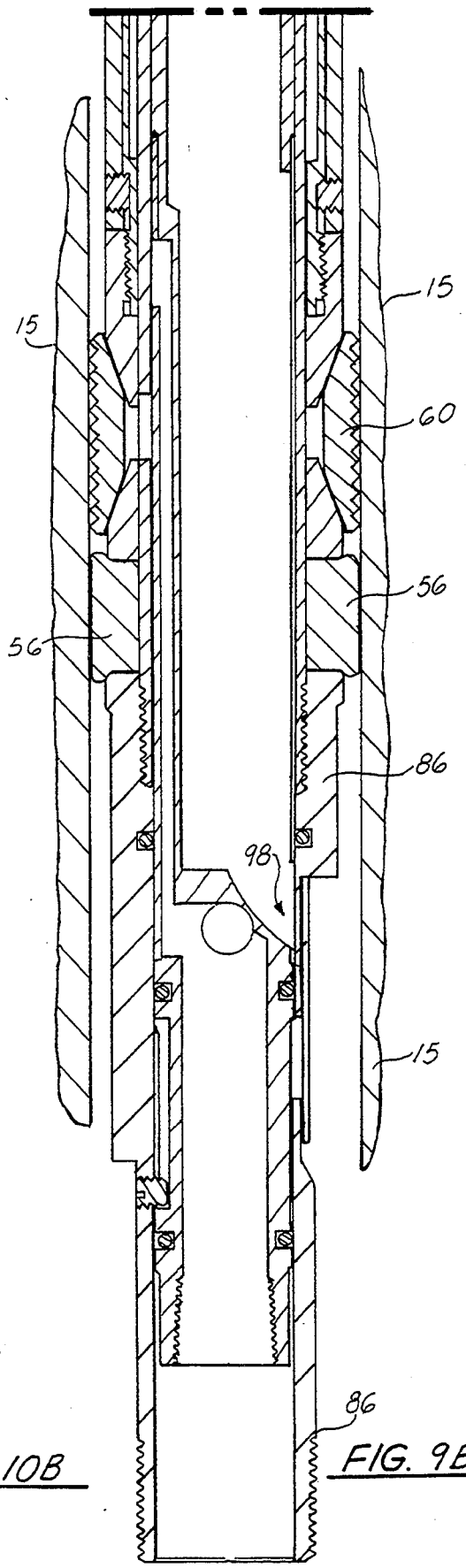

Gravel enters the annulus between casing 15 and annular sleeve 86, as shown in FIG. 10B. An elongated well screen 105 is supported upon threads at the bottom of the annular sleeve 86. This places the gravel flowing in bore 88 in the direction of arrows 103 in the well annulus outside of screen 105 and inside casing 15. The screen 105 maintains the gravel externally of the tool so that return clear fluid tracks the path of arrows 104 in return channels 108, returning to the surface via the annulus above annular packer element 56 as shown in FIG. 10B. Wash pipe 106 is attached to inner threads 111 of the cross over running tool 90. Wash pipe can extend for example 30–200 feet. The wash pipe 106 is simply a length of pipe with an open ended cylindrical bore. The wash pipe 106 thus requires flowing gravel (arrows 103) to travel to the bottom of screen 105 and to the bottom of wash pipe 106 before return flow (arrows 104) enters the bottom of the wash pipe. The screen 105 can extend a distance below the wash pipe 106, and is sealed at the bottom end so that return fluid does not include gravel. The gravel or coarse sand remains in the annulus between screen 105 and casing 15. The carrier fluid passes through the screen 10 and enters the open bottom end portion of wash pipe 106, then flows upwardly along the path defined by arrows 104. The wash pipe 106 is placed radially inside screen 105 (see FIG. 10, 10B). Screen 105 wash pipe 106 are about the same length (e.g. 30–200 feet).

Figure 14:
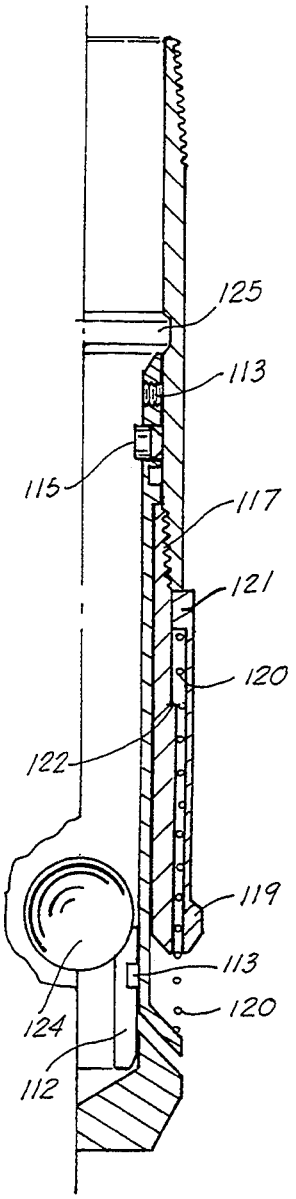
FIG. 14 is a sectional elevational view of the third embodiment of the apparatus of the present invention illustrating the ball and ball seat portions used in combination with the tool body to release a packer that has been stuck.
Figure 13:
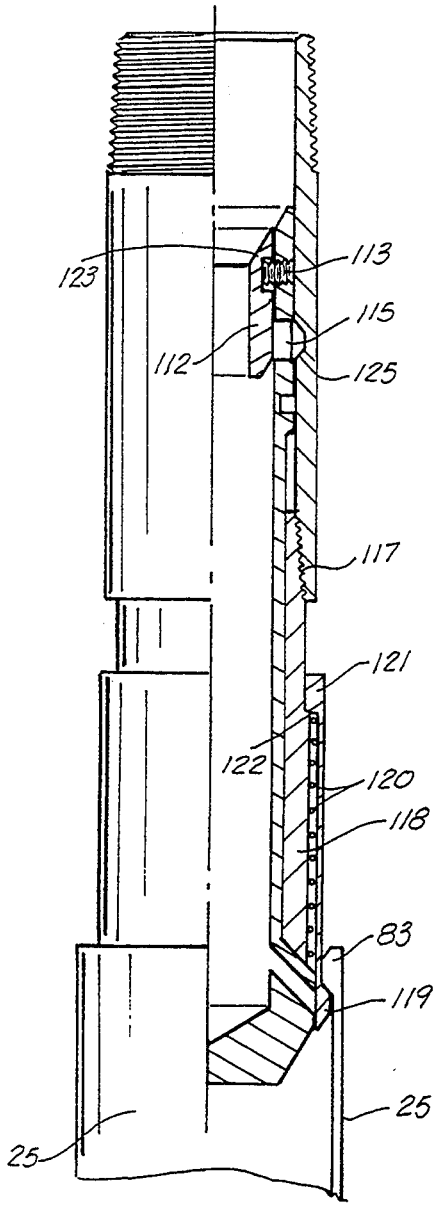
FIG. 13 is another sectional elevational view of the third embodiment of the apparatus of the present invention illustrating the pulling tool latched to the packer and during a removal thereof.
Figure 12:
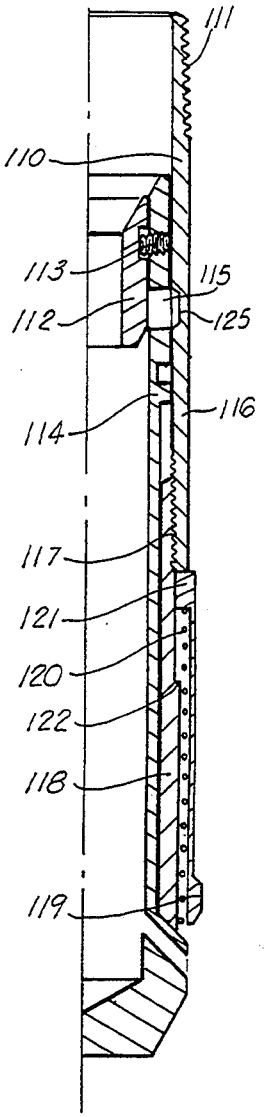
FIG. 12 is a sectional elevational view of yet another embodiment of the apparatus of the present invention showing a pulling tool for removing the packer.

FIG. 12–14 illustrate a pulling tool for removal of the packer 10. In FIG. 12, pulling tool 110 is shown having an upper threaded portion 111 that can attach to a collar (see for example FIG. 6) for joining the coil tubing 13 to the pulling tool 110 in the same manner that the cross over running tool 90 was attached to the coil tubing 13. Annular member 112 can slide up or down, but is initially held by pins 113 to inner tool body portion 114. The inner tool body portion 114 attaches with pins 115 to outer sleeve 116. Outer sleeve 116 forms a threaded connection at 117 to annular sleeve 118. A plurality of flexible and circumferentially spaced collet fingers 119 are supported upon annular portion 121 and below the sleeve member 116 and urged up against sleeve member 116 with coiled spring 120. The collet fingers 119 can flex inwardly when the tool is in the position shown in FIG. 12.

In FIG. 13, the collect fingers have engaged the top annular lip 83 of running tool 25. The operator then pulls up on the coil tubing 13. The annular enlarged shoulder portion 121 of collet fingers 119 engages annular shoulder 122 of annular member 118, as shown in FIG. 13. The operator then lifts the coil tubing 13. The coiled spring 120 is compressed during downward movement of the annular portion 121. The operator can then lift the running tool 25 and all of the attached portions of the packer 10 from the well bore.

If the tool 10 is stuck, a ball can be dropped down the center of the well bore until it registers upon an annular beveled seat 123 of annular member 112. The ball and seat 123 then form a seal so that when pressure is applied via the coil tubing bore, the member 112 and the ball 124 are a resistance. Responsive to an increase in pressure in the coil tubing bore, member 112 slides down and shear pin 113 is cut in half, as shown in FIG. 14. The annular member 112 slides downwardly to the position shown in FIG. 14.

This shifting of position of member 112 to the position shown in FIG. 14 removes the annular member 112 from its original position adjacent releasing pins 115. The releasing pins 115 can freely retract from annular groove 125 as shown in FIG. 14 so that at least the lower uncoiled portion 13 of the coil tubing and a portion of the tool can be removed from the hole when the packer 10 is stuck. The following table lists; the parts numbers and parts descriptions as used herein and in the drawings attached hereto.

PARTS LIST

| Part Number | Description |
|---|---|
| 10 | packer apparatus |
| 11 | coil tubing unit |
| 12 | coil portion |
| 13 | uncoiled portion |
| 14 | downhole portion |
| 15 | casing |
| 16 | wellhead |
| 17 | earth's surface |
| 18 | formation |
| 19 | running tool |
| 20 | internal threads |
| 21 | upper end |
| 22 | mandrel |
| 23 | indentation |
| 24 | rocker dog |
| 25 | setting sleeve |
| 26 | upper portion |
| 27 | medial portion |
| 28 | annular shoulder |
| 29 | lower end portion |
| 30 | threaded section |

-continued

PARTS LIST

| Part Number | Description |
|---|---|
| 31 | external threads |
| 32 | sleeve |
| 33 | threaded section |
| 34 | threads |
| 35 | annular shoulder |
| 36 | annular shoulder |
| 37 | recess |
| 38 | lock ring section |
| 39 | lock ring |
| 40 | inner surface |
| 41 | annular serrations |
| 42 | mandrel |
| 43 | thread |
| 44 | thread |
| 45 | thread |
| 46 | rear surface |
| 47 | front surface |
| 48 | annular shoulder |
| 49 | annular shoulder |
| 50 | check valve body |
| 51 | external threaded section |
| 52 | bore |
| 53 | internal threads |
| 54 | lower end |
| 55 | external threads |
| 56 | annular packer element |
| 57 | cone assembly |
| 58 | annular wedge element |
| 59 | annular wedge element |
| 60 | slip |
| 61 | threaded connection |
| 62 | annular sleeve |
| 63 | set screw |
| 64 | annular shoulder |
| 65 | port |
| 66 | hydraulic chamber |
| 67 | port |
| 68 | arrows |
| 69 | releasing screw |
| 70 | running screw |
| 71 | piston |
| 72 | O-ring |
| 73 | O-ring |
| 74 | O-ring |
| 75 | O-ring |
| 76 | O-ring |
| 77 | split ring |
| 78 | pin |
| 79 | arrow |
| 80 | polished bore |
| 81 | retrieving tool |
| 82 | annular lip |
| 83 | annular lip |
| 84 | annular shoulder |
| 85 | annular shoulder |
| 86 | annular sleeve |
| 87 | valve member |
| 88 | bore |
| 89 | mandrel |
| 90 | cross over running tool |
| 91 | wall |
| 92 | upper end |
| 93 | threads |
| 94 | collar |
| 95 | threads |
| 96 | lower end |
| 97 | valve flapper |
| 98 | opening |
| 99 | pin |
| 100 | slot |
| 101 | slot |
| 102 | slot |
| 103 | arrows |
| 104 | arrows |
| 105 | screen |
| 106 | wash pipe |
| 107 | annular shoulder |
| 108 | return channel |
| 109 | recess |

-continued

| PARTS LIST | |
|---|---|
| Part Number | Description |
| 110 | pulling tool |
| 111 | inner threads |
| 112 | annular member |
| 113 | pins |
| 114 | inner tool body |
| 115 | pins |
| 116 | sleeve |
| 117 | threaded connection |
| 118 | annular sleeve |
| 119 | collet fingers |
| 120 | coiled spring |
| 121 | shoulder |
| 122 | shoulder |
| 123 | seat |
| 124 | ball |
| 125 | wash pipe |
| 126 | lower end portion |
| 127 | internally threaded portion |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A hydraulic oil and gas well down hole packer apparatus in well casing below a wellhead at the earth's surface comprising:

a) a coil tubing unit having an elongated coil tubing portion, a reel portion for coiling the coil tubing thereupon and a free end portion that can De transmitted into the well casing below the wellhead;

b) a tool body having a central, longitudinally extending tool body bore, and an upper end portion with means for connecting the tool body to the coil tubing unit;

c) the coil tubing having a bore for transmitting pressurized fluid to the tool body bore;

d) the tool body having a hydraulic piston movably disposed thereon between running and setting positions;

e) the tool body having a sliding external sleeve portion connected at its lower end for movement with the hydraulic piston;

f) slip means on the tool body for engaging the casing to anchor the tool body to the casing at a selected position;

g) cone assembly means forming a connection between the piston and the slip means for activating the slip means to grip the well casing;

h) annular packer means, expandable by the cone assembly means, for forming a seal between the tool body and the casing at a position below the piston;

i) body lock ring means on the tool body for locking the sliding portion after it moves a certain downward distance; and j) the tool body including means for releasing the slips and the annular packer means so that the tool body can be retrieved, said means being operable responsive to tension applied to the tool body external sleeve portion.

2. The apparatus of claim 1 wherein the slip means comprises a plurality of slips.

3. The apparatus of claim 1 wherein the packer means is a resilient packer member.

4. The apparatus of claim 1 further comprising a check valve carried at the lower end portion of the tool body and communicating with the tool body bore for preventing fluid flow into the tool body from a position below the tool body.

5. The apparatus of claim 1 further comprising an annular sleeve positioned below the piston and connected for movement with the piston, the sleeve forming a connection between the piston and the cone assembly means.

6. A hydraulic oil and gas well down hole packer apparatus in well casing below a wellhead at the earth's surface comprising:

a) a coil tubing unit having an elongated coil tubing portion, a reel portion for coiling the coil tubing thereupon and a free end portion that can be transmitted into the well casing below the wellhead;

b) a tool body having a central, longitudinally extending tool body bore, and an upper end portion with means for connecting the tool body to the coil tubing unit;

c) the coil tubing having a bore for transmitting pressurized fluid to the tool body bore;

d) the tool body having a hydraulic piston movably disposed thereon between running and setting positions;

e) the tool body having a sliding portion connected for movement with the hydraulic piston;

f) slip means on the tool body for engaging the casing to anchor the tool body to the casing at a selected position;

g) cone assembly means forming a connection between the piston and the slip means for activating the slip means to grip the well casing;

h) annular packer means, expandable by the cone assembly means, for forming a seal between the tool body and the casing at a position below the piston;

i) body lock ring means on the tool body for locking the sliding portion after it moves a certain downward distance; and j) wherein the tool body comprises and uppermost running tool portion that has means for connecting to the coil tubing, a setting sleeve defining an outer member of the tool body, a mandrel positioned radially between the setting sleeve and the running tool portion, and wherein the piston is positioned between the mandrel and the setting sleeve.

7. The apparatus of claim 6 wherein the mandrel extends from a position above the piston to a position below the annular packer means.

8. The apparatus of claim 7 wherein the lower end of the mandrel carries a check valve.

9. A hydraulic oil and gas well down hole packer apparatus in well casing below a wellhead at the earth's surface comprising:

a) a coil tubing unit having an elongated coil tubing portion, a reel portion for coiling the coil tubing thereupon and a free end portion that can be transmitted into the well casing below the wellhead;

b) a tool body having a central, longitudinally extending tool body bore, and an upper end portion, and a lower end portion;

c) connection means for forming a connection between the tool body and the free end portion of the coil tubing;

d) the coil tubing having a bore for transmitting pressurized fluid to the tool body bore;

e) the tool body comprising an elongated tubular inner mandrel, a hydraulic piston movably disposed upon the mandrel between running and setting positions, and an external sleeve surrounding the mandrel and the piston;

f) the external sleeve defining a sliding portion connected at its lower end for movement with the hydraulic piston;

g) slip means on the tool body for engaging the casing to anchor the tool body to the casing at a selected position in the well casing;

h) means, forming a connection between the piston and the slip means, for activating the slip means to grip the well casing;

i) expandable annular packer means, expandable responsive to movement of the sliding portion for forming a seal between the tool body and the casing at a position below the piston; and j) the tool body including means for releasing the slips and the annular packer means so that the tool body can be retrieved, said means being operable responsive to tension applied to the tool body external sleeve.

10. The apparatus of claim 9 wherein the slip means comprises a plurality of circumferentially-spaced slips positioned around the inner mandrel.

11. The apparatus of claim 9 wherein the tool body comprises in part an upper,host running tool portion that includes means for connecting to the coil tubing, a setting sleeve defining in part the external sleeve member of the tool body, and a portion of the mandrel being positioned radially between the setting sleeve and the running tool portion, and wherein the piston is positioned adjacent the lower end of the running tool sleeve portion between the mandrel and the setting sleeve.

12. The apparatus of claim 11 wherein the inner mandrel extends from a position above the piston to a position below the annular packer means.

13. The apparatus of claim 12 wherein the lower end of the mandrel has means for releasably supporting a check valve.

14. The apparatus of claim 12 further comprising a check valve carried at the lower end portion of the tool body and communicating with the tool body bore for preventing fluid back flow into the tool body from a position below the tool body.

15. The apparatus of claim 9 wherein the external sleeve comprises in part an annular portion positioned below the piston and connected for movement with the piston when the piston moves downwardly, the annular portion forming a connection at its upper end to the piston and at its lower end to the cone assembly means.

16. A hydraulic oil and gas well down hole packer apparatus in well casing below a wellhead at the earth's surface comprising:

a) a coil tubing unit having an elongated coil tubing portion, a reel portion lot coiling the coil tubing thereupon and a free end portion that can be transmitted into the well casing below the wellhead;

b) a tool body having a central, longitudinally extending tool body bore and an upper end portion, and a lower end portion;

c) connection means for forming a connection between the tool body and the free end portion of the coil tubing;

d) the coil tubing having a bore for transmitting pressurized fluid to the tool body bore;

e) the tool body comprising an elongated tubular inner mandrel, a hydraulic piston movably disposed upon the mandrel between running and setting positions, and external sleeve surrounding the mandrel and the piston;

f) the external sleeve defining a sliding portion connected for movement with the hydraulic piston;

g) slip means on the tool body for engaging the casing to anchor the tool body to the casing at a selected position in the well casing;

h) means, forming a connection between the piston and the slip means, for activating the slip means to grip the well casing;

i) expandable annular packer means, expandable responsive to movement of the sliding portion for forming a seal between the tool body and the casing at a position below the piston; and j) wherein the packer means is a resilient annular packer member that surrounds the inner mandrel at the lower end portion of the tool body.

* * * * *